United States Patent [19]

Shirai et al.

[11] Patent Number: 4,536,749

[45] Date of Patent: Aug. 20, 1985

[54] SECURITY-ENSURING APPARATUS HAVING AN OPERATIONAL GUIDANCE FUNCTION

[75] Inventors: Shiro Shirai, Tachikawa; Shunji Ogahara, Musashino; Miyuki Kubo, Tokyo, all of Japan

[73] Assignee: Secom Co., Ltd., Tokyo, Japan

[21] Appl. No.: 503,739

[22] Filed: Jun. 13, 1983

[30] Foreign Application Priority Data

Jun. 14, 1982 [JP] Japan ..... 57-100749

[51] Int. Cl.[3] ..... G08B 25/00

[52] U.S. Cl. ..... 340/525; 340/506; 340/539; 340/531; 455/54

[58] Field of Search ..... 340/525, 506, 505, 500, 340/531, 524, 539, 825.06, 825.54, 825.55, 825.3, 825.36, 825.49; 179/5 R, 5 P; 455/39, 53, 54, 56, 67, 89, 90, 95

[56] References Cited

U.S. PATENT DOCUMENTS

| | | | |
|---|---|---|---|
| 2,919,307 | 12/1959 | Bachelet et al. | 179/5 R |
| 3,566,399 | 2/1971 | Weld | 340/506 |
| 3,678,391 | 7/1972 | Goush | 455/39 |
| 3,713,142 | 1/1973 | Getchell | 340/505 |
| 3,854,122 | 12/1974 | Cross | 340/825.06 |
| 3,882,465 | 5/1975 | Cook et al. | 340/825.06 |
| 3,925,763 | 12/1975 | Wadhwani et al. | 340/531 |
| 4,044,351 | 8/1977 | Everson | 340/505 |
| 4,141,006 | 2/1979 | Braxton | 340/505 |
| 4,228,424 | 10/1980 | Le Nay et al. | 340/506 |
| 4,356,475 | 10/1982 | Neumann et al. | 340/506 |
| 4,361,730 | 11/1982 | Barber et al. | 179/5 R |

*Primary Examiner*—Donnie L. Crosland

*Attorney, Agent, or Firm*—Armstrong, Nikaido, Marmelstein & Kubovcik

[57] ABSTRACT

A security-ensuring apparatus having an actuating unit for the initial actuation thereof, an alarm-mode selecting unit for selecting a desired alarm mode set in the apparatus, a separate or built-in emergency-detecting unit for detecting an emergency or an abnormality in a predetermined protected area in which the apparatus is arranged to ensure security, and a display unit for displaying diverse kinds of information regarding security, including information on the operating procedures thereof. The display unit has a visual displayer and/or an acoustic displayer and is accommodated in the casing of the security-ensuring apparatus.

11 Claims, 8 Drawing Figures

| Fig. 3A | Fig. 3 B | Fig. 3 C |
|---|---|---|

| Fig. 4A | Fig. 4B | Fig. 4C |
|---|---|---|

SECURITY-ENSURING APPARATUS HAVING AN OPERATIONAL GUIDANCE FUNCTION

BACKGROUND OF THE INVENTION

1. Field of the Invention

The present invention relates to a security-ensuring apparatus having the ability to display information regarding security as well as information on the operating procedures thereof. A security-ensuring apparatus of this type may be employed in an alarm system for protecting a predetermined area against unauthorized intrusions, the destruction of or removal of property, fire, equipment failure, etc.

2. Description of the Prior Art

Conventional security-ensuring apparatus for alarm systems employ a number of light-emitting diodes and electric lamps which turn on to display information regarding security. The light-emitting diodes and electric lamps are arranged on a display panel, each of them displaying predetermined section or sections of a protected area, and the names of the respective sections correspondingly appear on the display panel. Thus, the user of the alarm system and authorized personnel, such as dispatched engineers, must find the abnormal section or sections of the protected area and judge whether or not a particular alarm mode, i.e., the start of an unmanned alarm mode, might be set in the security-ensuring apparatus by inspecting the number of lit or unlit light-emitting diodes and lamps. This is very cumbersome. Further, if the area protected by the alarm system is large or complex, it is very difficult in the designing of the apparatus to arrange the display lamps and light-emitting diodes for a number of divided sections of the protected area, respectively. In addition, if an emergency or abnormality occurs in a section or sections of the protected area, it usually takes a very long time for the user or the dispatched engineers to arrive at the site of the emergency or abnormality after inspecting which light-emitting diodes and lamps on the display panel are lit. As a result, the prevention of crime and the control of fire, etc. can become impossible. This is a drawback of such an alarm system.

Further, it is quite natural that the conventional security-ensuring apparatus is operated only by well-trained and authorized personnel, such as dispatched engineers, considering the secrecy of the alarm system. Therefore, it is rather difficult for untrained persons and users to correctly operate the security-ensuring apparatus. In addition, in the applicant's past experience in controlling conventional alarm systems utilized by approximately one hundred thousand renters or owners, it was found that approximately 30 percent of the information regarding abnormalities transmitted to the central station was false information due to improper operation of a conventioanl security-ensuring apparatus by the users. That is to say, part of the false information resulted from the fact that the users set an unmanned alarm mode in their security-ensuring apparatus before confirming the absence of an abnormal condition in the area or areas to be protected by the alarm systems. The rest of the false information resulted from the fact that the users were not trained in operation of the security-ensuring apparatus. Upon the receipt of each piece of false information, the central station had to dispatch engineers to the site of the abnormality so that the engineers could deal with the abnormality and carry out necessary security-ensuring actions. Accordingly, the cost of controlling the alarm systems inevitably became high, with the result that the alarm systems were not widely used. Thus, it is very important that the security-ensuring apparatus be easy for untrained persons to operate.

The above-mentioned drawbacks of the conventional security-ensuring apparatus have prevented the wide utilization thereof in alarm systems.

SUMMARY OF THE INVENTION

An object of the present invention is to provide an information-displaying security-ensuring apparatus which is capable of obviating the above-mentioned drawbacks of the conventional security-ensuring apparatus.

Another object of the present invention is to provide a security-ensuring apparatus having the ability to display comprehensive information concerning alarm modes set, operating procedures, the site of the emergency or abnormality, and confirmation of operations, thereby giving immediate guidance in operation to the operators.

In accordance with the prevent invention, there is provided a security-ensuring apparatus which displays information and which is incorporated in an alarm system having emergency and abnormality sensors. The apparatus comprises an actuating unit for generating a signal to actuate the apparatus upon being operated by the use of a predetermined medium, a memory unit for storing therein display information including at least information on various alarm modes to be set in the apparatus, information on the operating procedures, and information on the location of the emergency sensors, a display unit for displaying display information supplied from the memory unit, a drive unit for directing supply of the display information from the memory unit to the display unit upon the receipt of the actuating signal from the actuating unit, a selector unit for selecting a desired alarm mode to be set in the apparatus when the display unit displays the display information, a selection-controlling unit for operating, via the drive unit and the memory unit, the display unit to display the desired alarm mode selected by the selector unit, a first discriminating unit for discriminating appropriateness of the desired alarm mode selected by the selector unit, and a setting unit connected to the memory unit, the drive unit, and the first discriminating unit for registering the desired alarm mode in the memory unit upon the receipt of a signal indicating appropriate selection from the first discriminating unit. Preferably, the security-ensuring apparatus further comprises an emergency-detecting unit connected to both the emergency sensors of the alarm system and the setting unit for sending an emergency-detection signal to the setting unit, the setting unit operating, via the drive unit and the setting unit, the display unit to display information on the site of the emergency upon the receipt of the emergency-detection signal from the emergency-detecting unit, and a second discriminating unit connected to the selection-controlling unit and the emergency-detecting unit for actuating the emergency-detecting unit upon the receipt of a signal of selection of a predetermined alarm mode from the selection-controlling unit. Preferably, the display unit is accommodated in a casing for encasing therein the security-ensuring apparatus.

BRIEF DESCRIPTION OF THE DRAWINGS

The present invention will be more apparent from the ensuing description of the preferred embodiments, with reference made to the accompanying drawings, wherein.

It should be noted here that in the entire description of the specification and claims, the various alarm modes, including the start of an unmanned alarm mode for the entire protected area, the start of an unmanned alarm mode for a designated section or sections of the protected area, the termination of the unmanned alarm mode for the entire protected area, the termination of the unmanned alarm mode for designated section or sections of the protected area, patrolling, the start of maintenance, and the termination of maintenance, are generally referred to as "the alarm mode".

Figure 1:
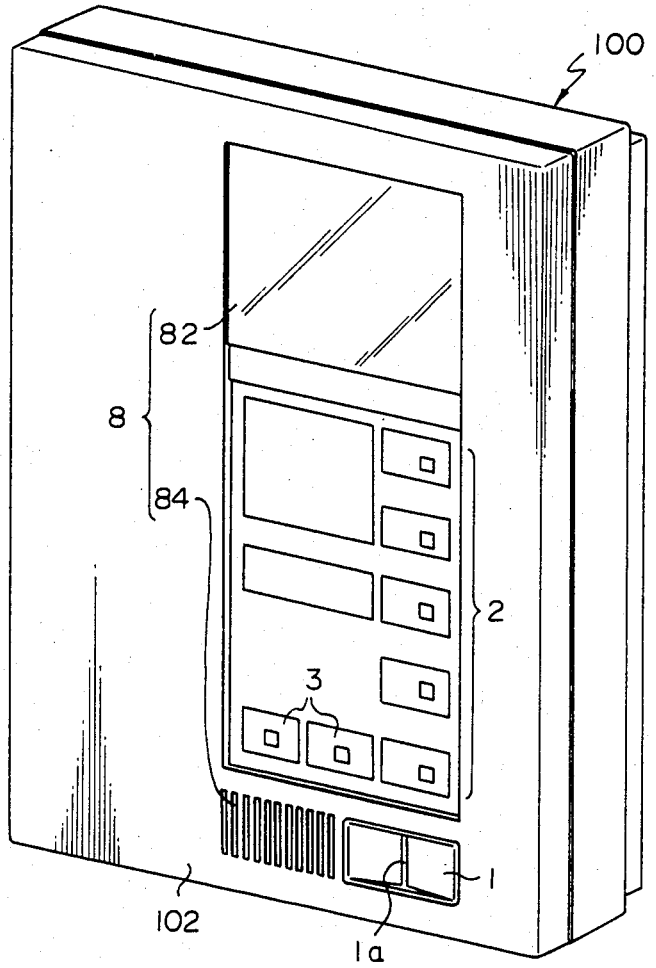
FIG. 1 is a perspective outer view of a security-ensuring apparatus according to an embodiment of the present invention.

Referring to FIG. 1, a security-ensuring apparatus is enclosed in a casing 100 usually made of cast plastic and having a front face 102. On the front face 102, there are arranged an actuating unit 1 comprising, for example, a card reader having a card insertion slit 1a, a mode-selecting unit 2 comprising numbered push buttons for selecting respective alarm modes, a mode-confirming unit 3 comprising push buttons for confirming selection of a desired alarm mode, and a display unit 8 (FIG. 3) comprising a cathode-ray tube (CRT) displayer or a liquid crystal displayer 82, and a loudspeaker 84. The CRT displayer 82 or the liquid crystal displayer 82 is provided so as to visually alarm operators of or users of the apparatus while the loudspeaker 84 is provided so as to acoustically alarm the operators or the users. The loudspeaker 84 may be arranged on either of the side faces of the casing 100.

Figure 2:
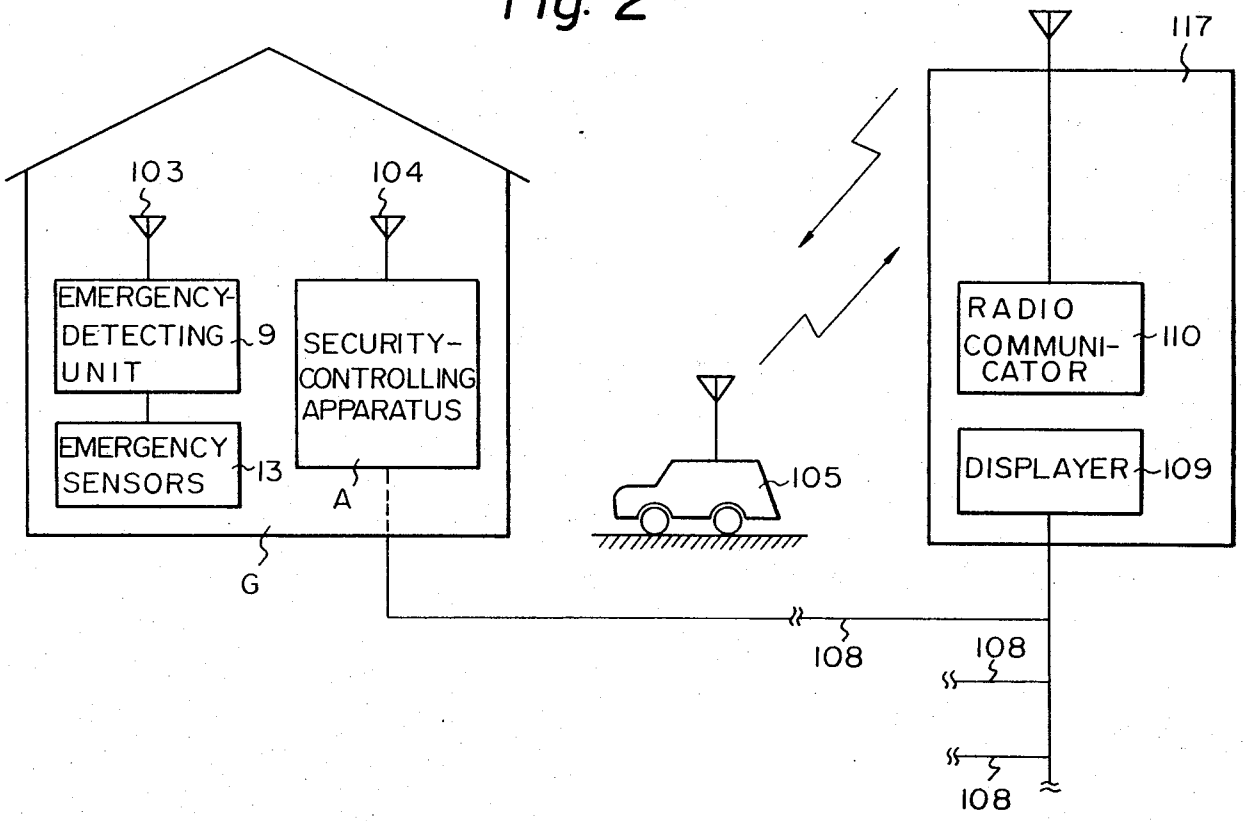
FIG. 2 is a schematic block diagram of an example of an alarm system in which the security-ensuring apparatus of FIG. 1 is incorporated.

As is shown in FIG. 2, the securing-ensuring apparatus A of the present invention is incorporated in an alarm system for a predetermined protected area G, such as the user's office or residence, and is installed in the predetermined protected area G. The alarm system is constituted of one or more emergency sensors 13 arranged in suitable places within the protected area G which detect an emergency, such as fire, unauthorized intrusions, the destruction of or unauthorized removal of property, a battery-powered emergency-detecting unit 9 connected to the emergency sensors 13, the security-ensuring apparatus A installed in the protected area G and connected to the emergency-detectig unit 9 by means of a radio transmission via antennas 103 and 104, and a central station 117 connected to the security-ensuring apparatus A by means of a signal transmission line 108. The central station 117 per se is provided as a central monitoring station for many like alarm systems for many protected areas and has a displayer 109 on which the current conditions of the respective protected areas are always displayed by means of various kinds of displaying devices, such as electric lamps, buzzers, CRT displayers, and so on. When an emergency or emergencies are sensed and detected in the protected area G, information on the emergency or emergencies is immediately transmitted, via the line 108, to the central station 117, where the emergency or emergencies are monitored. The monitors of the central station 117 then dispatch engineers to the protected area G and the emergency or emergencies are adequately handled. A dispatch car 105 is used to transport the dispatched engineers to the protected area G. The security-ensuring apparatus A is a central controller which ensures the security of the protected area A.

Figures 3, 3A:
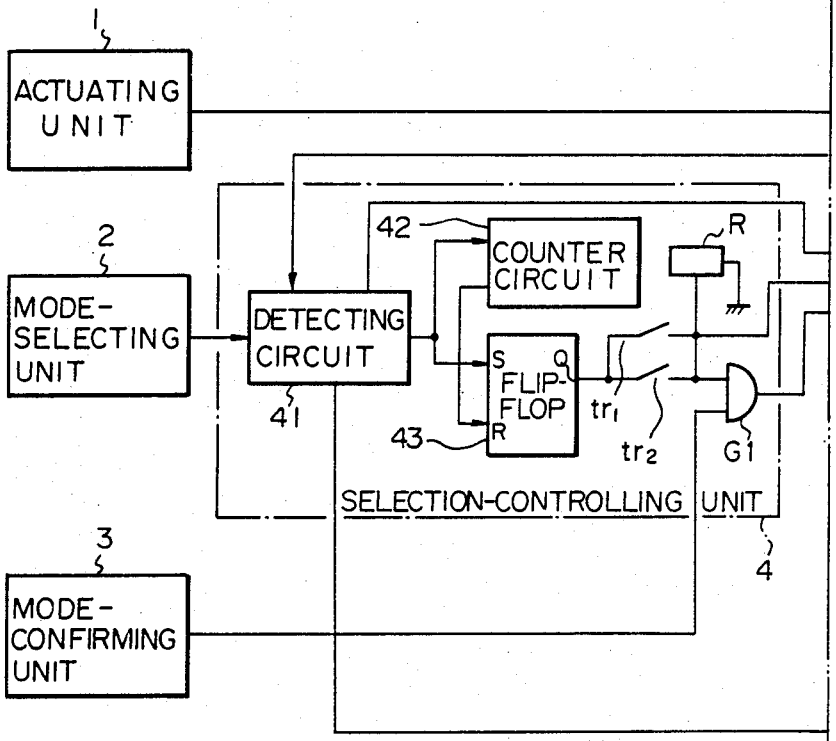
FIG. 3 that includes
FIGS. 3A–3C is a block diagram illustrating the internal arrangement of a security-ensuring apparatus according to an embodiment of the present invention.
Figure 3B:
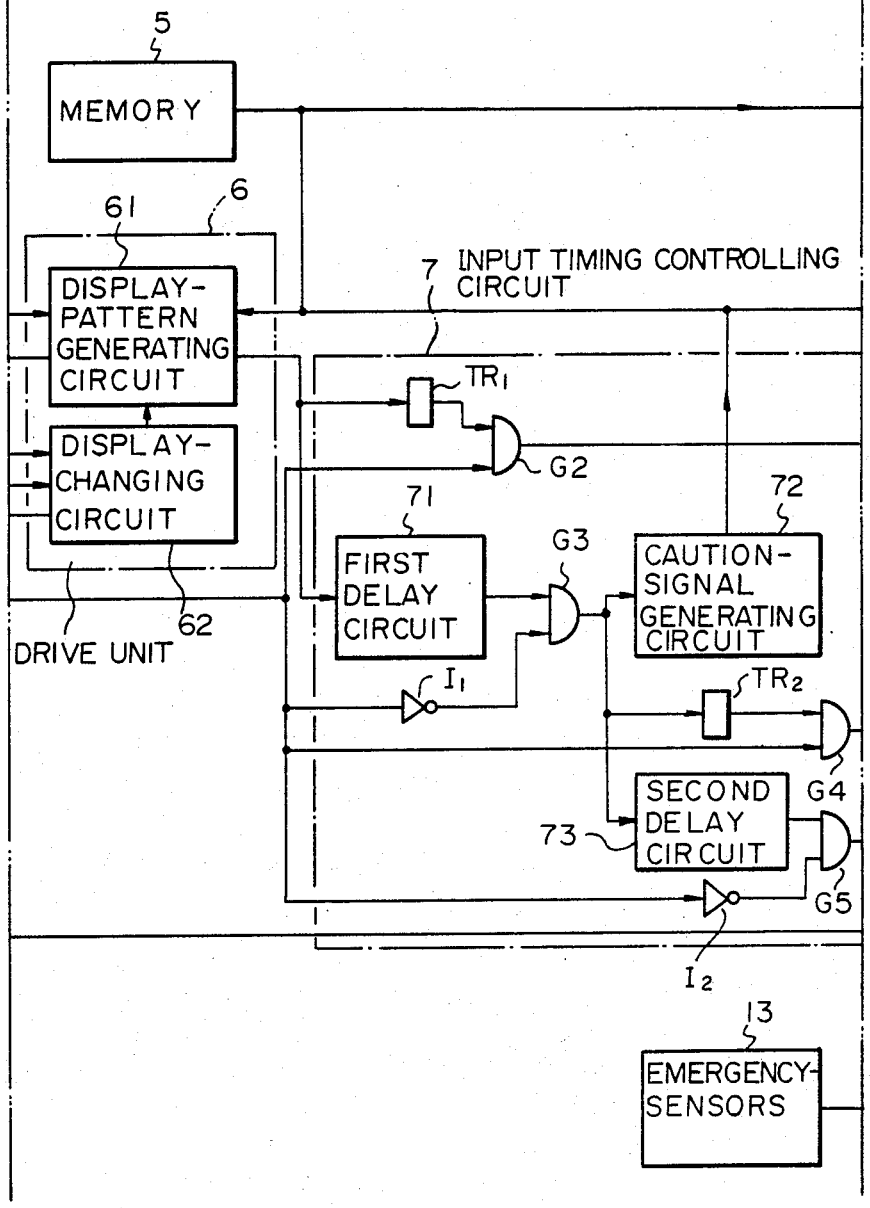
Figure 3C:
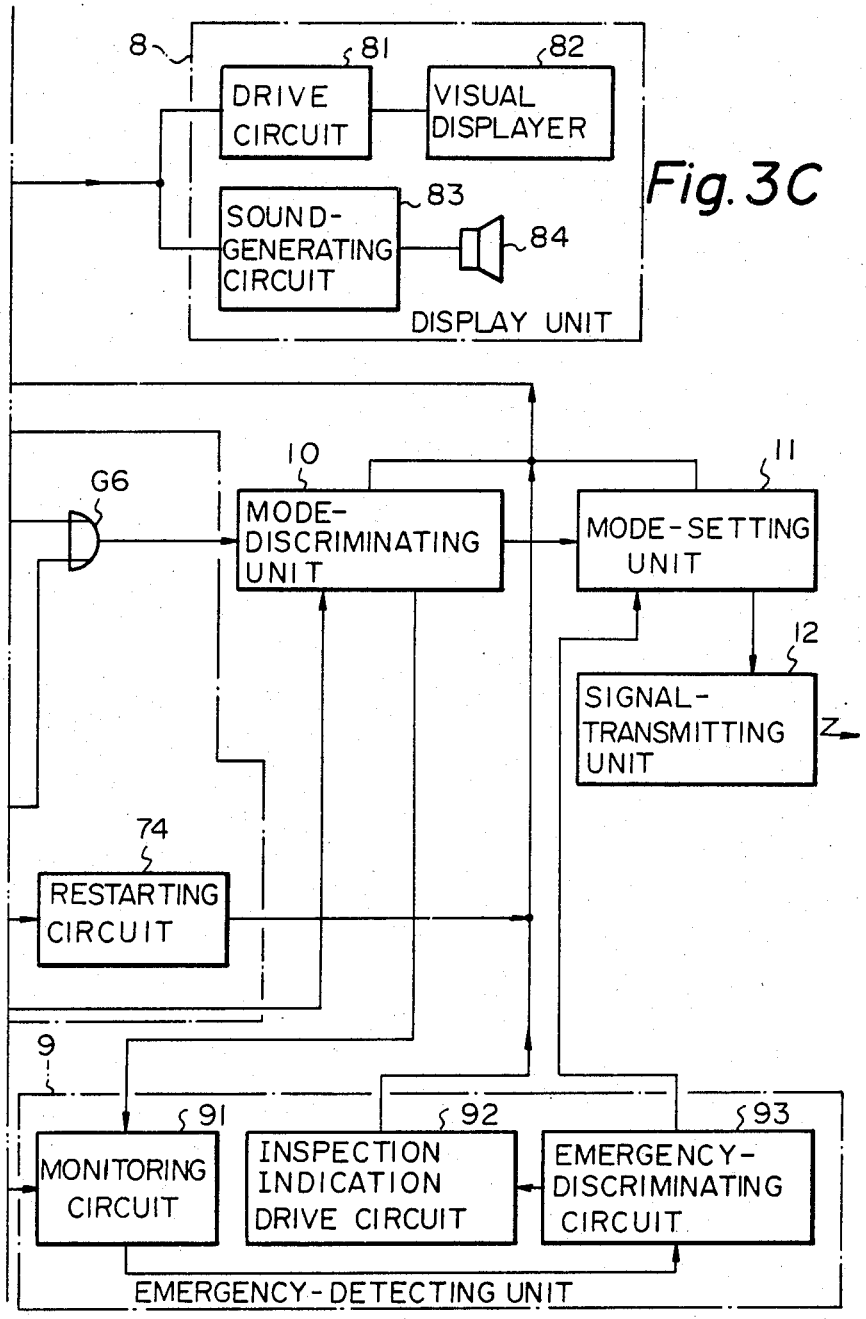

Referring to FIG. 3, which illustrates an embodiment of the internal arrangement of the security-ensuring apparatus, there are arranged an actuating unit 1, a mode-selecting unit 2, a mode-confirming unit 3, a selection-controlling circuit 4, a memory 5, a drive unit 6, an input-timing controlling circuit 7, a display unit 8, an emergency-detecting unit 9, a mode-discriminating unit 10, a mode-setting unit 11, and a signal-transmitting unit 12. Emergency sensors 13 all connected to the emergency-detecting unit 9 are arranged in suitable places within the predetermined protected area, as was mentioned previously.

The actuating unit 1 includes a reading circuit for reading a predetermined actuating medium, such as keys or magnetic cards. When the actuating medium is manually inserted in and withdrawn from the actuating unit 1, the actuating unit 1 generates an actuating signal.

The mode-selecting unit 2 used for selecting a desired alarm mode includes therein an OR circuit having input terminals, each corresponding to one of the alarm modes. In order to allow manual selection of the desired alarm mode, the mode-selecting unit 2 comprises push button switches, the outputs of which are connected to the input terminals of the OR circuit. The mode-selecting unit 2 may comprise keys or a combination of magnetic cards and a card reader.

The mode-confirming unit 3 is provided for confirming the correctness of selection by the mode-selecting unit 2. The unit 3 preferably comprises push button switches, as is illustrated in FIG. 1. However, it may comprise keys or a combination of magnetic cards and a card reader.

The selection-controlling circuit 4 comprises a detecting circuit 41 connected to the mode-selecting unit 2 so as to detect a signal from the unit 2, a counter circuit 42 having an input terminal connected to the detecting circuit 41, a flip-flop circuit 43 having a set input S connected to the detecting circuit 41, a reset input R connected to the counter circuit 42 and an output Q, an AND gate G1 having an input terminal connected to the mode-confirming unit 3 and an input terminal connectable to the output Q of the flip-flop circuit 43 via a contact tr2, and a solenoid relay R.

The memory 5 comprises conventional read-only memory circuits capable of storing therein display information on alarm modes, the positions of the emergency sensors, an illustrative map of the protected area, guidance, and so on. The memory 5 also comprises a conventional random-access memory circuit in which an actual alarm mode set in the security-ensuring apparatus is erasably stored. The memory 5 is connected to the drive unit 6, the display unit 8, and the mode-setting unit 11.

The input-timing controlling unit 7 is provided for controlling the timing of signals and comprises first and second delay circuits 71 and 73, respectively, a caution-signal generating circuit 72, a restarting circuit 74, four AND gates G2 through G5, and a OR gate G6.

The drive unit 6 comprises a display-pattern generating circuit 61 and a display-changing circuit 62. The display-pattern generating circuit 61 is connected to the actuating unit 1, the detecting circuit 41 of the selection-controlling circuit 4, the memory 5, the caution-signal generating circuit 72 of the input-timing controlling unit 7, the display unit 8, the emergency-detecting unit 9, the mode-discriminating unit 10, and the mode-setting unit 11. The display-changing circuit 62 is connected to the detecting circuit 41, the AND gate G1, the flip-flop circuit 43, and the display-pattern generating circuit 61. That is, the drive unit 6 is provided for driving the display unit 8 in response to signals from the actuating unit 1, the emergency-detecting unit 9, the mode-discriminating unit 10, the mode-setting unit 11, and the caution-signal generating circuit 72 and the restarting circuit 74 of the input-timing controlling circuit 7. More specifically, the drive unit 6 drives the display unit 8 to display "caution" information in response to a signal from the caution-signal generating circuit 72, to display "inspection" information in response to a signal from the mode-discriminating unit 10, to display "inspection position" and "inspection command" information in response to signals from the emergency-detecting unit 9 and the memory 5, to display "before actuation" information in response to signals from the restarting circuit 74 and the memory 5, and to display information on the diverse alarm modes in response to signals from the actuating unit 1, the selection-controlling circuit 4, and the memory 5.

The display unit 8 comprises a drive circuit 81, a visual displayer 82, such as a liquid crystal displayer or a CRT displayer, a sound-generating circuit 83, and a loudspeaker 84. On the visual displayer 82, the alarm modes, confirmation of the modes, the operating procedures, and an illustration of the site of the emergency on a map are displayed. The loudspeaker 84 is provided so as to give acoustic guidance.

The emergency-detecting unit 9 connected to diverse emergency sensors 13 comprises a monitoring circuit 91, an inspection indication drive circuit 92, and an emergency-discriminating circuit 93. The monitoring circuit 91 is connected to the mode-discriminating unit 10, the emergency sensors 13, and the emergency-discriminating circuit 93. The inspection indication drive circuit 92 is connected to the emergency-discriminating circuit 93 and the drive unit 6.

The mode-discriminating unit 10 is provided so as to discriminate whether or not the selected alarm mode is the start of the unmanned alarm mode as well as whether or not the selected alarm mode desired to be set is adequate with respect to the actual alarm mode currently set.

The mode-setting unit 11 is provided so as to set a given alarm mode in the apparatus as well as so as to write the actual alarm mode in the memory 5. The mode-setting unit 11 is connected to the signal-transmitting unit 12 so as to give it a signal indicating the actual alarm mode. Therefore, the unit 12 transmits the signal from the unit 11 to, for example, the central station (FIG. 2), which is usually located at a place remote from the protected area.

The operation of the security-ensuring apparatus and the above-mentioned embodiment thereof are now described.

In the ordinary operation of the apparatus, when the owner operates the actuating unit 1 with a key or by inserting and withdrawing a magnetic card, the reading circuit of the unit 1 determines whether or not operation with the key or the magnetic card is correct. If it is correct, the actuating unit 1 generates an actuation signal to be sent to the display-pattern generating circuit 61 of the drive unit 6. Upon receipt of the actuation signal, the display-pattern generating circuit 61 reads out the display information stored in the memory 5 and drives the display unit 8 to display information on the operating procedures, the alarm modes, and so on. Therefore, the display unit 8 displays, on the visual displayer 82, such display information and generates acoustic information on the operating procedures and guidance by means of the sound-generating composition circuit 83 and the loudspeaker 84. For example, "Please select a desired alarm mode." is broacast. At the same time, the display-pattern generating circuit 61 transmits an operating signal to a timer relay TR1 and to the first delay circuit 71 of the input-timing controlling circuit 7 so that they are operated. At this stage, the first delay circuit 71 has a delay time which is as long as the limiting time of the timer relay TR1. While the timer relay TR1 is being operated, the contact tr1 thereof is closed. Subsequently, the user operates the mode-selecting unit 2 so as to select a desired alarm mode according to the information displayed on the display unit 8. The selected alarm mode is detected by the detecting circuit 41 of the selection-controlling circuit 4. That is, a signal indicating the mode selected by user is issued by the mode-selecting unit 2 and is detected by the detecting circuit 41. However, since the detecting circuit 41 has a memory function to store therein the same information as that displayed on the displayer 82, if the user selects an alarm mode other than that displayed on the displayer 82, the detecting circuit 41 does not detect this alarm mode. That is, the detecting circuit 41 cancels the selected alarm mode.

In the procedure of detecting the selected alarm mode, the detecting circuit 41 issues a signal indicating a mode setting or a mode changing to the counter circuit 42 so that the circuit 42 counts "1". The same signal is also transmitted from the detecting circuit 41 to the set input S of the flip-flop circuit 43. As a result, from the output Q of the flip-flop circuit 43, the mode-setting signal or the mode-changing signal is transmitted to the display-changing circuit 62 of the drive unit 6. On the other hand, the detection signal of the detecting circuit 41 is transmitted to the display-changing circuit 62, via the contact tr1. Then the display-changing circuit 62 drives, via the display-pattern generating circuit 61, the display unit 8 so that the selected alarm mode is displayed on the visual displayer 82 and so that the acoustic instruction "Please confirm the selected mode" is broadcast over the loudspeaker 84. As a result, the user looks at the visual displayer 82 and listens to the broadcast over the loudspeaker 84. If the user's selection is correct, the user operates the mode-confirming unit 3.

Further, since the contact tr1 of the timer relay TR1 is closed, the mode-setting signal or the mode-changing signal from the flip-flop circuit 43 is applied to one of the inputs of the AND gate G1 via the closed contact tr1 and a mode-confirming signal from the mode-confirming unit 3 is applied to the other input of the AND gate G1. As a result, a signal appears on the output of the AND gate G1 and is applied to one of the inputs of the AND gate G2 of the input-timing controlling circuit 7 while the other input of the AND gate G2 is supplied with a signal from the timer relay TR1. Therefore, a signal appears on the output of the AND gate G2 and is transmitted to one of the inputs of the OR gate G6. That is, selection of the alarm mode and confirmation of the selected alarm mode are both performed during the limiting time of the timer relay TR1, and a signal is transmitted from the AND gate G2 to one of the inputs of the OR gate G6. An output signal from the OR gate G6 is therefore sent to the mode-discriminating unit 10, to which the signal of the selected mode is also transmitted from the detecting circuit 41 of the selection-controlling unit 4. As a result, the mode-discriminating unit 10 discriminates whether or not the selected mode is "the start of the unmanned alarm mode" for the entire protected area or for certain sections of the protected area. If not, the signal of the selected alarm mode is transmitted from the unit 10 to the mode-setting unit 11. Thus, the mode-setting unit 11 registers the selected alarm mode in the memory 5 as an actual alarm mode and simultaneously sends the selected alarm mode to the signal-transmitting unit 12, through which the central station is informed of the selected alarm mode. On the other hand, the mode-setting unit 11 drives, via the drive unit 6, the display unit 8 so that the completion of setting of the desired and selected alarm mode is displayed in the form of an appropriate symbol or word so that the acoustic instruction, for example, "termination of the unmanned alarm mode" is broadcast over the loudspeaker 84. The display unit 8 may either retain such display information on the visual displayer 82 or cancel it after a predetermined time period.

A case where the user does not operate the mode-confirming unit 3 is now described.

The timer relay TR1 is operated so that the contact tr1 thereof is kept closed. However, no signal is applied from the mode-confirming unit 3 to the AND gate G1. As a result, no signal appears on the output of the AND gate G1. On the other hand, at the end of operation of the timer relay TR1, the first delay circuit 71 having the same delay time as the limiting time of the timer relay TR1 generates a signal on the output thereof which is applied to one of the inputs of the AND gate G3. To the other input of the AND gate G3, a signal is applied from an inverter $I_1$ arranged between the AND gates G1 and G3. Thus, the AND gate G3 sends an output signal to the caution-signal generating circuit 72. Therefore, the circuit 72 drives, via the display-pattern generating circuit 61 of the drive unit 6, the display unit 8 so that a caution signal indicating the non-confirmation of operations is displayed on the visual displayer 82 and so that the acoustic instruction "Please confirm the selected mode." is broacast over the loudspeaker 84.

The output signal of the AND gate G3 is also applied to both the timer relay TR2 and the second delay circuit 73. Thus, during operation of the timer relay TR2, if the user operates the mode-selecting unit 2 and the mode-confirming unit 3, an output signal appears on the output of the AND gate G1 and is transmitted to the AND gate G4. As a result, the AND gate G4 generates an output signal to be sent to the OR gate G6. Accordingly, the OR gate G6 performs the same operation as stated previously.

At this stage, it should be noted that a contact of the solenoid relay R is arranged in the mode-confirming unit 3. The contact of the relay R is kept closed while the mode-selecting operation or the mode-changing operation is carried out.

On the other hand, during the operation of the timer relay TR2, if the user oprates neither the mode-selecting unit 2 nor the mode-confirming unit 3, the second delay circuit 73, which has a delay time identical to the limiting time of the timer relay TR2 and which is operated simultaneously with the timer relay TR2, generates a delay signal at the end of operation of the timer relay TR2. The delay signal is transmitted to one of the inputs of the AND gate G5, the other input of which is supplied with a signal from an inverter $I_2$ arranged between the AND gate G1 and the AND gate G5. Therefore, the AND gate G5 generates an output signal to be sent to the restarting circuit 74, which is connected to the drive unit 6. Accordingly, the drive unit 6 reads the actual alarm mode out of the memory 5 and also drives the display unit 8 so that the actual alarm mode, as well as a symbol or word instructing restarting of the actuating unit 1, is displayed on the visual displayer 82 and so that an acoustic instruction for restarting of the actuating unit 1 by the use of, for example, a magnetic card i.e. "Please insert a magnetic card" is broadcast over the loudspeaker 84. Consequently, the user may again operate the actuating unit 1 according to the displayed instructions.

A case where the alarm mode is incorrectly selected by the user is now described.

When the user initially selects a given alarm mode by operation of the mode-selecting unit 2, the selected alarm mode is displayed by the display unit 8. If the user notes that selection of the alarm mode is incorrect from the information displayed by the display unit 8, the user again operates the mode-selecting unit 2 so as to select the same alarm mode as the initially incorrect selection. Before the mode-confirming unit 3 is operated, the AND gate G1 receives only the initial mode-selection signal or mode-changing signal. Therefore, when the user again operates the mode-selecting unit 2, the detecting circuit 41 detects that the same alarm mode has been selected twice and operates the countercircuit 42. Accordingly, the counter circuit 42 initially set at "1" is set at "0". This signal "0" is applied to the reset input R of the flip-flop circuit 43 so that the output signal of the output Q of the flip-flop circuit 43 disappears. As a result, supply of the initial mode-selection signal or mode-changing signal to the AND gate G1 from the flip-flop circuit 43 is stopped. Consequently, the incorrect initial selection of the alarm mode can be cancelled.

In the above-mentioned procedures, if the user fails to select the same alarm mode as the initially selected alarm mode, i.e., if the user selects an alarm mode different from the initial one, the detecting circuit 41 cancels the second selected alarm mode. That is, in the apparatus of FIG. 3, during the operation of the timer relay TR1 or the timer relay TR2, if the same alarm mode is selected twice prior to the operation of the mode-confirming unit 3, the initial operation of the mode-selecting unit 2 is automatically cancelled. Alternatively, an appropriate cancelling means, such as a cancelling button switch, may preliminarily be arranged in the mode-selecting unit 2. In such a case, cancelling of the mode-selecting operation may preferably be displayed by the display unit 8.

The setting of the unmanned alarm mode for all of or part of the sections of the predetermined protected area is now described.

The operating procedures from operation of the actuating unit 1 by the use of a key or a magnetic card to the discriminating operation by the mode-discriminating unit 10 are carried out in the manner previously described.

Now, if the desired and selected alarm mode is discriminated to be the start of the unmanned alarm mode by the mode-discriminating unit 10, the mode-discriminating unit 10 operates, via the display-pattern generating circuit 61 of the drive unit 6, the display unit 8 to visually and acoustically indicate that the entire protected area or of the protected area is being inspected. The mode-discriminating unit 10 also sends a signal to the monitoring circuit 91 of the emergency-detecting unit 9. The monitoring circuit 91 then monitors the emergency sensors 13 in order to determine whether or not there is an emergency or abnormality in the entire protected area or in part of the protected area prior to the start of the unmanned alarm mode. If no emergency or abnormality is sensed by the emergency sensors 13, the monitoring circuit 91 signals the emergency-discriminating circuit 93 that there is no emergency or abnormality anywhere in the protected area. The emergency-discriminating circuit 93 then sends a signal to the mode-setting unit 11, which in turn operates, via the drive unit 6, the display unit 8 so as to visually display the mode of "start of the unmanned alarm mode". At the same time, the instruction "start of the unmanned alarm mode" is broadcast over the loudspeaker 84.

On the contrary, if either an emergency or an abnormality is detected, the emergency-discriminating circuit 93 signals this information to the inspection indication drive circuit 92. Thus, the circuit 92 operates the display-pattern generating circuit 61 of the drive unit 6 so as to read the map of the protected area and the location of the emergency sensors 13 out of the memory 5. As a result, the circuit 61 drives the display unit 8 so as to display, on the visual displayer 82, the site of the emergency or abnormality on the map. The site of the emergency or abnormality is preferably indicated by the intermittent turning on of lights. At the same time, the instruction to the site of the emergency or abnormality is broadcast over the loudspeaker 84.

If the unmanned alarm mode for part of the protected area is to be set, the user selects this mode, as well as a desired section or sections of the protected area, by means of the mode-selecting unit 2. The display unit 8 then displays the desired section or sections on the map on the visual displayer 82. Therefore, the user is able to confirm whether or not the desired section or sections of the predetermined protected area are correctly selected. Alternately, the desired section or sections of the protected area may be selected after the unmanned alarm mode is confirmed by the mode-confirming unit 3.

Figures 4, 4A:
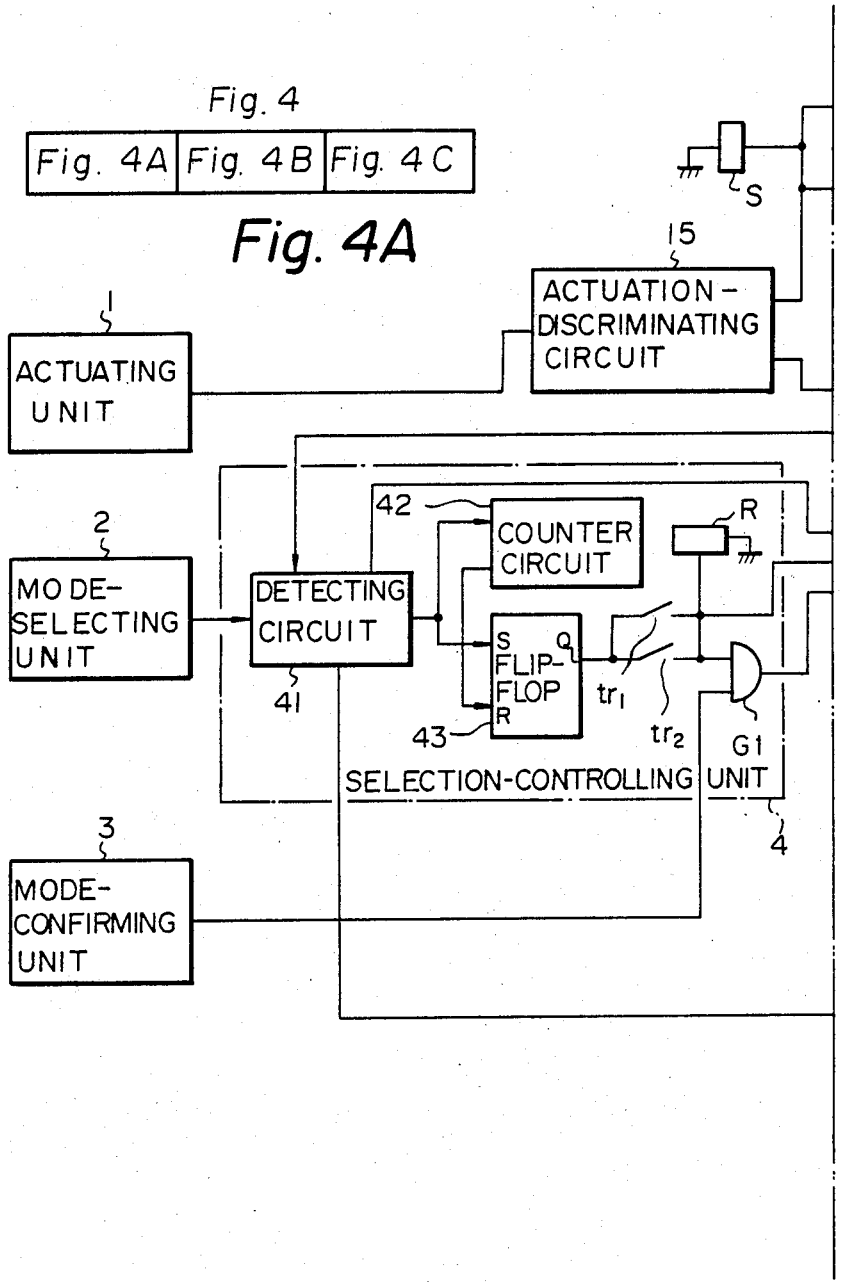
FIG. 4 that includes
FIGS. 4A–4C is a block diagram similar to that of FIG. 3 illustrating the internal arrangement of a security-ensuring apparatus according to another embodiment of the present invention.
Figure 4B:
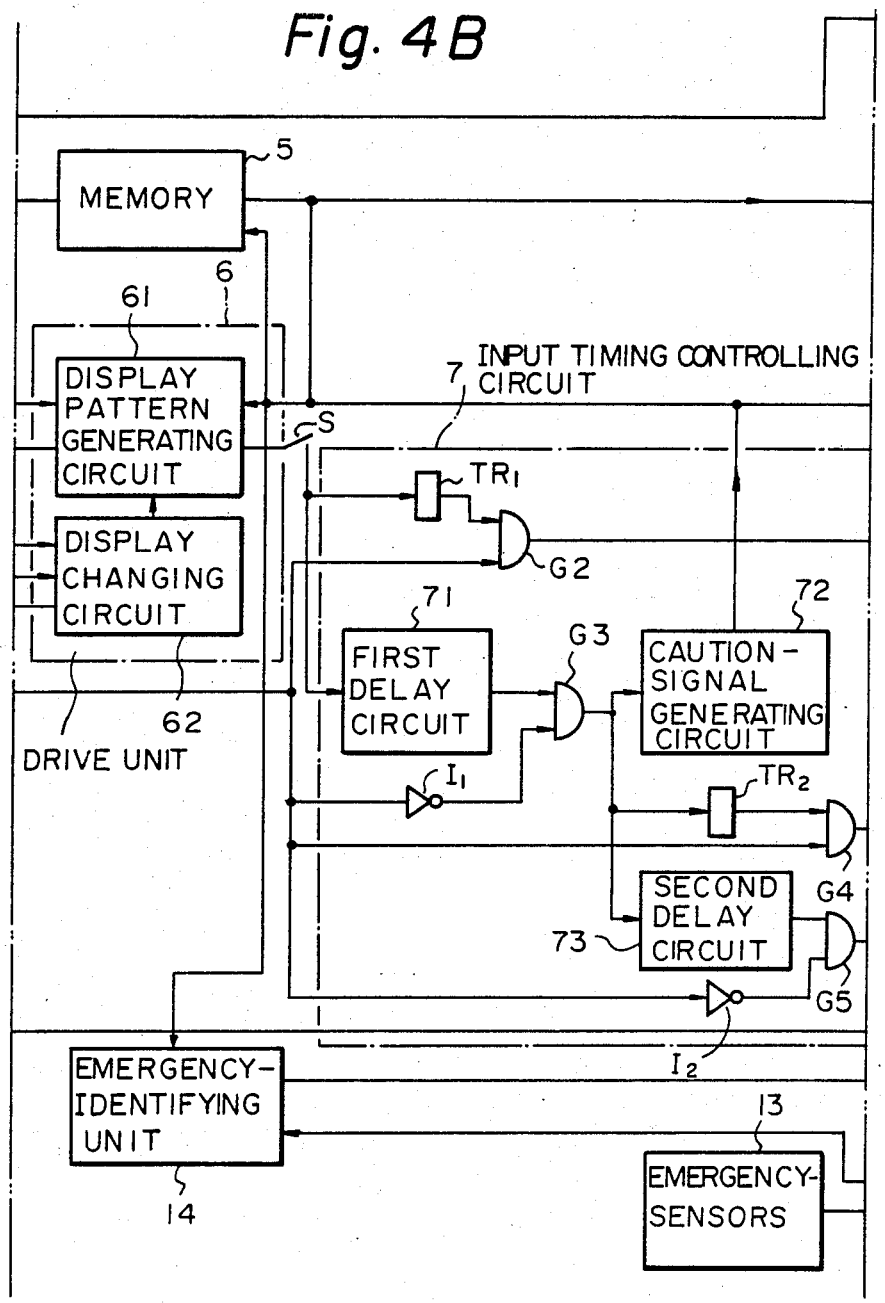
Figure 4C:
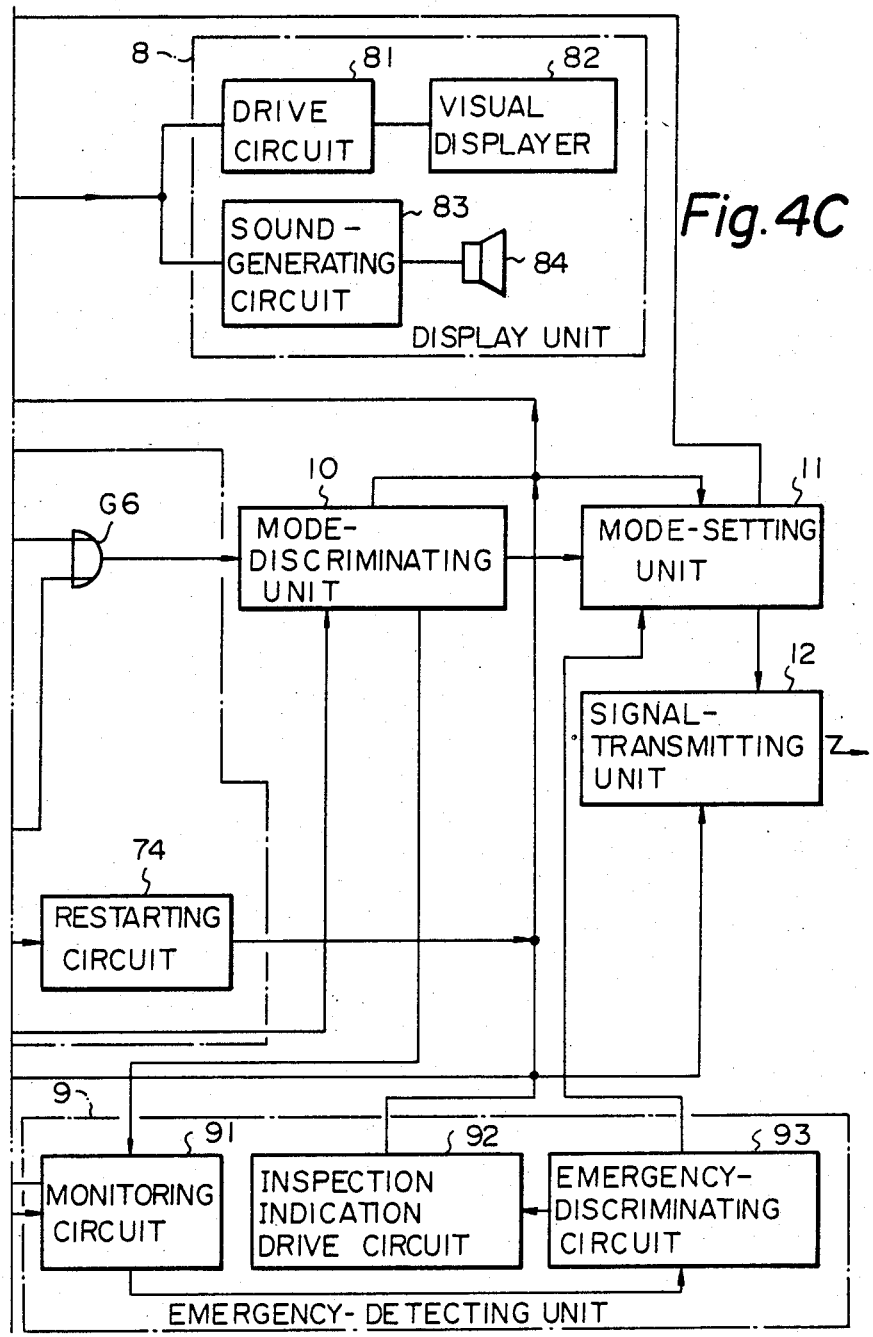

FIG. 4 illustrates another embodiment of the internal arrangement of the security-ensuring apparatus of the present invention. The same reference numerals as those of the aforementioned embodiment designate the same units and circuits. The difference between the internal arrangement of FIG. 4 and that of FIG. 3 is that the internal arrangement of FIG. 4 includes an emergency-identifying unit 14, an actuation-discriminating circuit 15, and a solenoid relays.

The particular operation of the embodiment is described hereinafter.

When the emergency sensor or sensors 13 sense, in the area protected by the security-ensuring apparatus of FIG. 4, an emergency or abnormality, such as an intrusion, fire, equipment failure, or gas leakage, the sensed emergency or abnormality is detected by the monitoring circuit 91 of the emergency-detecting unit 9. Therefore, a detecting signal is transmitted from the emergency-detecting unit 9 to the memory 5 via the emergency-identifying unit 14. As a result, the memory 5 sends a signal indicating the actual emergency alarm mode set in the apparatus to the emergency-identifying unit 14, which in turn determines whether or not the detected signal from the monitoring circuit 91 is real. If it is real, an emergency signal is transmitted to the central station (not illustrated in FIG. 4) via the signal-transmitting unit 12. Simultaneously, the emergency signal is also transmitted to the drive circuit 6, which in turn drives the display unit 8 so as to display information on the position of the detected emergency or abnormality in the form of a flashing light on the map of the protected area.

At this stage, the display unit 8 may first display a symbol or a word indicating the type of emergency or abnormality. Moreover, when either the user or the dispatched engineers operate the actuating unit 1 or the dispatched engineers select the mode of "patrol" on the mode-selecting unit 2, the display unit 8 may further display information on the site of the detected emergency or abnormality on the map of the protected area by means of the visual displayer 82. In addition, some information may be acoustically displayed, including information on the site of the emergency. For example, information that there is an abnormality around the window on the west side of the protected area may be broadcast over the loudspeaker 84.

Regarding the embodiment of FIG. 3, there was described the setting of a desired alarm mode and the changing of an alarm mode by selecting the desired mode from a plurality of different alarm modes. However, the embodiment of FIG. 4 is hereinafter described with regard to a case where the setting of a desired mode instead of the actual alarm mode or the changing of an alarm mode is carried out under a predetermined condition. That is it should be understood that, for example, after the start of the unmanned alarm mode, only the termination of the unmanned alarm mode can be set.

The user initially operates the actuating unit 1 by the insertion and withdrawal of a key or a magnetic card, and the reading circuit of the actuating unit 1 determines whether or not it is correct. If it is correct, an actuation signal is transmitted from the actuating unit 1 to the actuation-discriminating circuit 15, which in turn reads the actual alarm mode set in the apparatus out of the memory 5 and discriminates which mode or modes can be set in place of the actual alarm mode set in the apparatus. If it is discriminated that one of a plurality of alarm modes can be set, the plurality of alarm modes is sent to the display-pattern generating circuit 61 of the drive unit 6. Thus, the display-pattern generating circuit 61 drives the display unit 8 so as to display the plurality of alarm modes. Thereafter, the same operating procedures as those of FIG. 3 are carried out.

On the other hand, if it is discriminated by the actuation-discriminating circuit 15 that only a single alarm mode can be set, the circuit 15 sends a signal indicating the single alarm mode to the mode-setting unit 11. Thereafter, the same operating procedures as those of FIG. 3 are carried out. At this stage, as soon as the signal is sent from the actuation-discriminating circuit 15 to the mode-setting unit 11, the solenoid relay S is energized so as to open a contact S arranged between the display-pattern generating circuit 61 and the input-timing controlling unit 7. Accordingly, operation of the unit 7 is not prevented.

From the foregoing description of the embodiments of the present invention, it will be understood that according to the present invention, the security-ensuring apparatus may readily be operated by any untrained person, such as the user of the apparatus, due to information and guidance visually and acoustically displayed by the display unit accommodated in the casing of the apparatus. In addition, the visually and acoustically displayed guidance and information, including information on the operating procedures, ensure the prevention of errors during operation of the security-ensuring apparatus by the user and/or the dispatched engineers, thereby enabling a designated area to be reliably and rapidly protected.

It should further be understood that various changes and modifications may be made in the described embodimemts within the spirit and scope of the present invention. For example, the actuating unit 1 may comprise push button switches, ten-key switches or photoelectric sensing means. Furhter, the security-ensuring apparatus may comprise an appropriate covering for the casing, which can be locked with a key. The unlocking of the covering with a key directly initiates operation of the actuating unit. The display unit may comprise either a visual displayer or an acoustic displayer. Further, the display unit may be designed so as to always visually display the operating procedures of the security-ensuring apparatus per se.

In addition, the mode-confirming unit may be omitted since the displaying of diverse information on the display unit greatly contributes to the prevention of an error in the operation of the apparatus.

It should, moreover, be understood that the interconnection of the security-ensuring apparatus of the present invention and the central station is not indispensable, i.e., the apparatus may be used in a local alarm system.

We claim:

1. A security-ensuring apparatus which is capable of displaying information and which is incorporated in an alarm system having emergency sensors, comprising:

an actuating means for generating an actuation signal for said apparatus upon being operated by the use of a predetermined medium;

a memory means for storing therein display information including at least information on various types of alarm modes, information on operating procedures, and information on the location of said emergency sensors;

a display means coupled to said memory means for displaying said display information supplied from said memory means;

a drive means coupled to said display means and said actuating means for directing the supply of said display information from said memory means to said display means upon the receipt of said actuation signal from said actuating means;

a selector means for selecting a desired alarm mode to be set in said security-ensuring apparatus when said display means displays said display information;

a selection-controlling means having an input coupled to said selector means and an output coupled to said drive means for controlling said display means through said drive means and said memory means, such that said display means displays an alarm mode selected by said selector means;

a first discriminating means operatively coupled to said selection controlling means for discriminating the appropriateness of said selected mode by said selector means; and a setting means connected to said memory means, said drive means, and said first discriminating means for registering said selected alarm mode in said memory means upon the receipt of a signal indicating appropriate selection from said first discriminating means.

2. A security-ensuring apparatus as claimed in claim 1, further comprising a casing means for encasing therein said apparatus, said display means being accommodated in said casing means at an appropriate position for being monitored by operators.

3. A security-ensuring apparatus as claimed in claim 1, further comprising a signal-sending means, connected to said setting means, for sending a signal of said desired alarm mode to the outside of said apparatus.

4. A security-ensuring apparatus as claimed in claim 2, wherein said casing means has a front face and wherein said display means comprises a liquid crystal display unit fitted in said front face of said casing means.

5. A security-ensuring apparatus as claimed in claim 2, wherein said casing means has a front face and wherein said display means comprises a cathode-ray-tube display unit fitted in said front face of said casing means.

6. A security-ensuring apparatus as claimed in claim 2, wherein said display means comprises an acoustic display unit having a loudspeaker fitted in a part of said casing means.

7. A security-ensuring apparatus as claimed in claim 1, further comprising:

an emergency-detecting means connected to both said emergency sensors and said setting means so as to send an emergency-detecting signal to said setting means, said setting means operating, via said drive means and said memory means, said display means to display said information on the site of an emergency upon the receipt of said emergency-detecting signal from said emergency-detecting means; and a second discriminating means connected to said selection-controlling means and said emergency-detecting means for actuating said emergency-detecting means upon the receipt of a signal indicating the selection of a predetermined alarm mode from said selection-controlling means.

8. A security-ensuring apparatus as claimed in claim 4, further comprising a signal-sending means connected to said setting means for sending a signal of said desired alarm mode to said alarm system.

9. A security-ensuring apparatus as claimed in claim 1, further comprising a mode-confirming means for confirming the correctness of selection of said desired operating mode when said display means displays said desired alarm mode.

10. A security-ensuring apparatus as claimed in claim 1, wherein said predetermined medium is a key.

11. A security-ensuring apparatus as claimed in claim 1, wherein said predetermined medium is a magnetic card read by a card reader of said actuating means.

* * * * *